US006409558B1

(12) United States Patent
Gokan et al.

(10) Patent No.: US 6,409,558 B1
(45) Date of Patent: Jun. 25, 2002

(54) TURBOCHARGED ENGINE STRUCTURE FOR SMALL-SIZED BOAT

(75) Inventors: Yoshitsugu Gokan; Naoto Hara; Masatoshi Suzuki, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/714,135

(22) Filed: Nov. 17, 2000

(30) Foreign Application Priority Data

Nov. 19, 1999 (JP) ..... 11-329461

(51) Int. Cl.[7] ..... B63H 21/32
(52) U.S. Cl. ..... 440/89; 60/599
(58) Field of Search ..... 440/89; 123/563; 60/599

(56) References Cited

U.S. PATENT DOCUMENTS 4,075,991 A * 2/1978 Mettig et al. ..... 123/119 CD
4,562,697 A * 1/1986 Lawson ..... 60/599

FOREIGN PATENT DOCUMENTS

JP 59119926 8/1984

OTHER PUBLICATIONS

English language abstract of JP59–119926.

* cited by examiner

*Primary Examiner*—Ed Swinehart
(74) *Attorney, Agent, or Firm*—Birch, Stewart, Kolasch & Birch, LLP

(57) ABSTRACT

To provide a small-sized boat wherein a sufficient supercharging effect can be achieved. An engine having an exhaust manifold is disposed such that a crankshaft thereof extends in forward and rearward directions of a boat body, and an exhaust gas turbo charger which is driven to rotate by exhaust gas from the exhaust manifold is provided rearwardly of and adjacent to the exhaust manifold and rearwardly of and adjacent to the engine. The exhaust gas turbo charger is disposed such that a shaft which connects a turbine and a compressor is directed in leftward and rightward directions of the boat body, and the turbine is disposed adjacent to the exhaust manifold and the compressor is disposed adjacent to an intake port of the engine. An inter cooler is provided sidewardly of the compressor and disposed below an intake chamber.

14 Claims, 7 Drawing Sheets

TURBOCHARGED ENGINE STRUCTURE FOR SMALL-SIZED BOAT

BACKGROUND OF THE INVENTION

1. Field of the Invention

This invention relates to a small-sized boat principally of the saddle type. More particularly, the present invention relates to a small-sized boat which includes a turbo charger (supercharger).

2. Description of Background Art

Conventionally, such a boat as shown in FIGS. 7(*a*) and 7(*b*) includes a turbo charger. Such a boat is set forth in the Official Gazette of Japanese Utility Model Laid-Open No. Sho. 59 119926.

This small-sized boat provides for part of the pressure water generated in a jet propeller 1 to be supplied as cooling water A to an engine 2, and includes a turbo charger 3 which in turn includes a turbine 3*a* which is rotated by the cooling water A supplied from the jet propeller 1 to the engine 2 and a compressor 3*b* which is rotated by the turbine 3*a* within an intake path of the engine.

It is to be noted that in FIGS. 7(*a*) and 7(*b*), an exhaust manifold 4 is provided together with a muffler 5, an exhaust silencer 6, an exhaust chamber 7, and an exhaust gas exit 8 to the outside of the boat body.

Since the turbo charger 3 of the conventional small-sized boat described above is so structured that it is driven by the cooling water A flowing from the jet propeller 1 toward the engine 2, there is the possibility that a sufficient supercharging effect cannot be anticipated.

SUMMARY AND OBJECTS OF THE INVENTION

It is an object of the present invention to solve such a problem as described above and provide a small-sized boat wherein a sufficient supercharging effect can be anticipated.

To attain the object described above, a small-sized boat includes an engine having an exhaust manifold disposed such that a crankshaft thereof extends in the forward and backward directions of a boat body. An exhaust gas turbo charger which is driven to rotate by exhaust gas from the exhaust manifold is provided rearwardly of the exhaust manifold.

According to the present invention, a small-sized boat includes an exhaust gas exit for the exhaust gas from the exhaust gas turbo charger which is exhausted to the outside of the boat body and is disposed rearwardly of the turbo charger.

According to the present invention, a small-sized boat includes an exhaust gas turbo charger provided rearwardly of and very close to the exhaust manifold.

According to the present invention, a small-sized boat includes an exhaust gas turbo charger disposed rearwardly of and very close to the engine.

According to the present invention, a small-sized boat includes the exhaust gas turbo charger disposed such that a shaft which connects a turbine and a compressor thereof to each other is directed in leftward and rightward directions of the boat body, and the turbine is disposed adjacent to the exhaust manifold and the compressor is disposed adjacent to an intake port of the engine.

According to the present invention, a small-sized boat includes an inter cooler connected to the compressor of the exhaust gas turbo charger and is provided sidewardly of the compressor.

According to the present invention, a small-sized boat includes an inter cooler connected to a compressor of the exhaust gas turbo charger and is disposed below an intake chamber which follows the inter cooler and is provided sidewardly of the engine.

With the small-sized boat according to the present invention, since the exhaust gas turbo charger is driven to rotate by exhaust gas from the exhaust manifold of the engine and is provided rearwardly of the exhaust manifold, a sufficient supercharging effect can be obtained.

Further, since the engine is disposed such that the crankshaft thereof extends in the forward and rearward directions of the boat body and the exhaust gas turbo charger is provided rearwardly of the exhaust manifold, the exhaust gas turbo charger can be provided without suffering from very much damage due to the weight balance of the boat.

In other words, the weight balance of the boat can be maintained while the exhaust gas turbo charger is provided.

With the small-sized boat according to the present invention, since the exhaust gas exit for exhaust gas from the turbo charger is exhausted to the outside of the boat body and is disposed rearwardly of the exhaust gas turbo charger, laying or disposition of members of an exhaust system such as an exhaust pipe can be performed readily.

For example, if it is assumed that, in the conventional small-sized boat (FIGS. 7(*a*) and 7(*b*)) described hereinabove, the exhaust turbo charger is disposed rearwardly of the exhaust manifold 4, then since the exhaust gas exit 8 is provided at a front portion of the boat body, laying of an exhaust pipe from the turbo charger is complicated. Further, if it is assumed that the exhaust gas turbo charger is disposed forwardly of the exhaust manifold 4, then although it is considered that laying of an exhaust pipe from the turbo charger is facilitated, there is the possibility that the weight balance of the boat in this instance is damaged significantly.

In contrast, with the small-sized boat according to the present invention, since the exhaust gas exit for exhaust gas which has come out of the turbo charger and is to be exhausted to the outside of the boat body is disposed rearwardly of the turbo charger, laying or disposition of members of an exhaust system such as an exhaust pipe can be performed readily, and the weight balance of the boat is not damaged significantly.

With the small-sized boat according to the present invention, since the exhaust gas turbo charger in the small-sized boat is provided rearwardly of and very close to the exhaust manifold, the exhaust gas turbo charger is driven efficiently, and as a result, a more sufficient supercharging effect can be obtained.

In addition, since the exhaust gas turbo charger is provided rearwardly of and very close to the exhaust manifold, the weight balance is maintained (concentration of the weight is achieved), and the steering performance of the boat body is not damaged although the turbo charger is provided.

With the small-sized boat according to the present invention, since the exhaust gas turbo charger in the small-sized boat is provided rearwardly of and very close to the engine, the weight balance is maintained (concentration of the weight is achieved), and the steering performance of the boat body is not damaged although the turbo charger is provided.

With the small-sized boat according to the present invention, since the exhaust gas turbo charger in the small-sized boat is disposed such that the shaft which connects the turbine and the compressor thereof to each other is directed in the leftward and rightward directions of the boat body, the exhaust gas turbo charger can be disposed more closely to the engine. Accordingly, it is possible to keep the weight balance much better (to achieve a concentration of the weight), and as a result, the steering performance of the boat body can be maintained although the turbo charger is provided.

Further, since the turbine of the turbo charger is disposed adjacent to the exhaust manifold and the compressor is disposed adjacent to the intake port of the engine, connection between the exhaust gas turbo charger and the engine can be performed readily.

With the small-sized boat according to the present invention, since, the inter cooler is connected to the compressor of the exhaust gas turbo charger, the supercharging efficiency of the exhaust gas turbo charger is augmented. Besides, since the inter cooler is provided sidewardly of the compressor, the weight balance can be maintained (concentration of the weight is achieved), and as a result, the steering performance of the boat body can be maintained although the turbo charger and the inter cooler are provided.

With the small-sized boat according to the present invention, since the inter cooler is connected to the compressor of the exhaust gas turbo charger, the supercharging efficiency of the exhaust gas turbo charger is augmented. Besides, since the inter cooler is disposed below the intake chamber which follows the inter cooler and is provided sidewardly of the engine, even if water should enter the turbo charger, the water is less likely to be admitted into the body of the engine. Accordingly, the engine body is less likely to be damaged.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
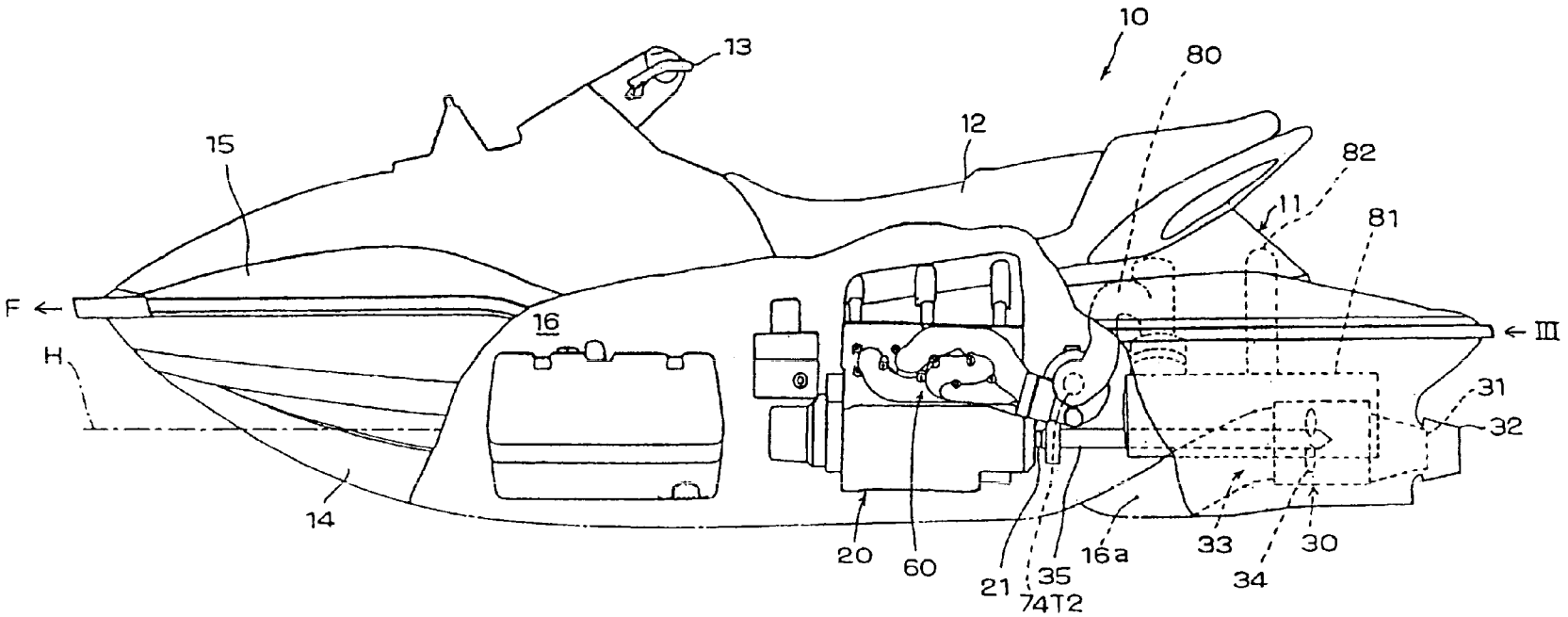
FIG. 1 is a partial schematic side elevational view, partly broken away, showing an embodiment of a small-sized boat according to the present invention.
Figure 2:
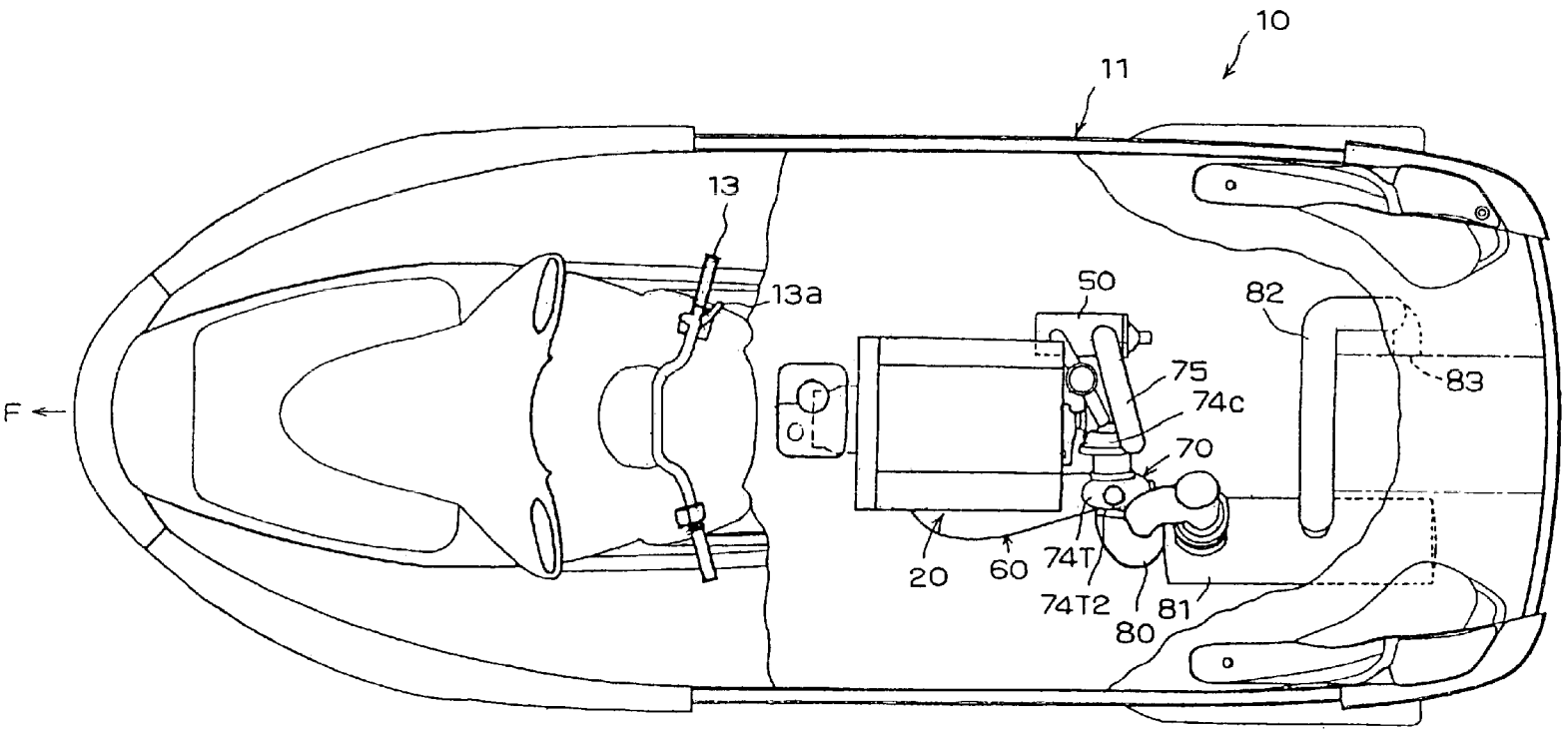
FIG. 2 is a top plan view of the small-sized boat according to the present invention.
Figure 3:
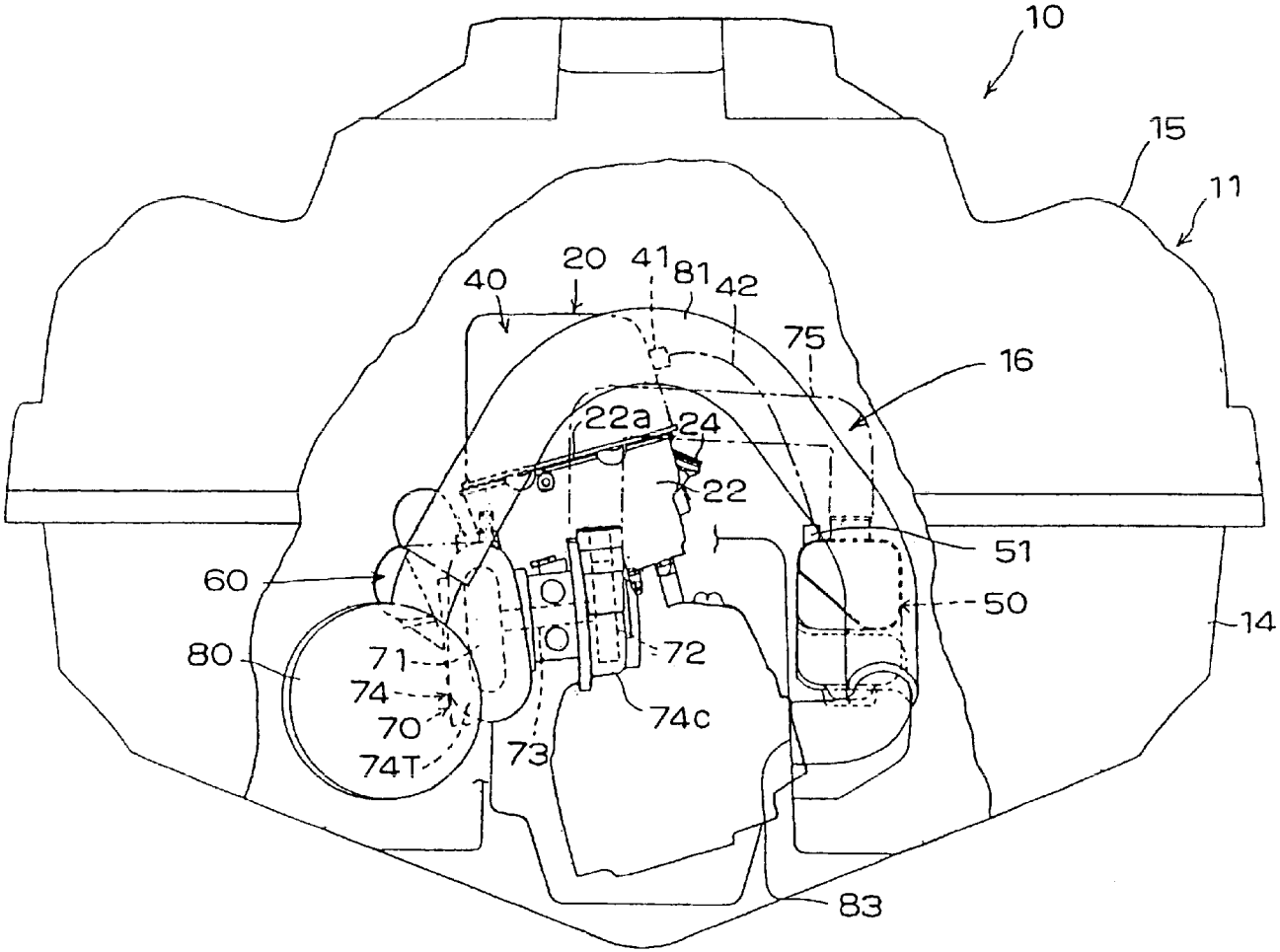
FIG. 3 is a rear elevational view, partly broken away, of the small-sized boat (as viewed in a direction of an arrow mark III of FIG. 1)

In the following, an embodiment of the present invention is described with reference to the drawings. As shown in FIGS. 1 to 3 (principally in FIG. 1), the small-sized boat 10 of the present embodiment is a saddle type small-sized boat that can be steered by a steering handle bar 13 with a throttle lever gripped by a passenger seated on a seat 12 on a boat body 11.

The boat body 11 has a floating body structure wherein a lower hull panel 14 and an upper hull panel 15 are jointed together with a space 16 formed therebetween. In the space 16, an engine 20 is placed on the lower hull panel 14, and a jet pump 30 serving as propelling means driven by the engine 20 is provided at a rear portion of the lower hull panel 14.

The jet pump 30 has a flow path 33 extending from a intake 16*a* opened to the bottom of the boat to a jet 31 opened to a rear end of the boat body and a nozzle 32, and an impeller 34 disposed in the flow path 33, and a shaft 35 of the impeller 34 is connected to an output power shaft 21 of the engine 20. Accordingly, if the impeller 34 is driven to rotate by the engine 20, then water taken in through the intake 16*a* is jetted from the jet 31 past the nozzle 32, whereby the boat body 11 is propelled. The driving speed of the engine 20, that is, the propelling force by the jet pump 30, is controlled by a revolving operation of a throttle lever 13*a* (refer to FIG. 2) of the steering handle bar 13 described above. The nozzle 32 is associated with the steering handle bar 13 by a control wire not shown and is controlled to be turned by an operation of the handle bar 13, whereby the advancing direction can be changed.

Figure 4:
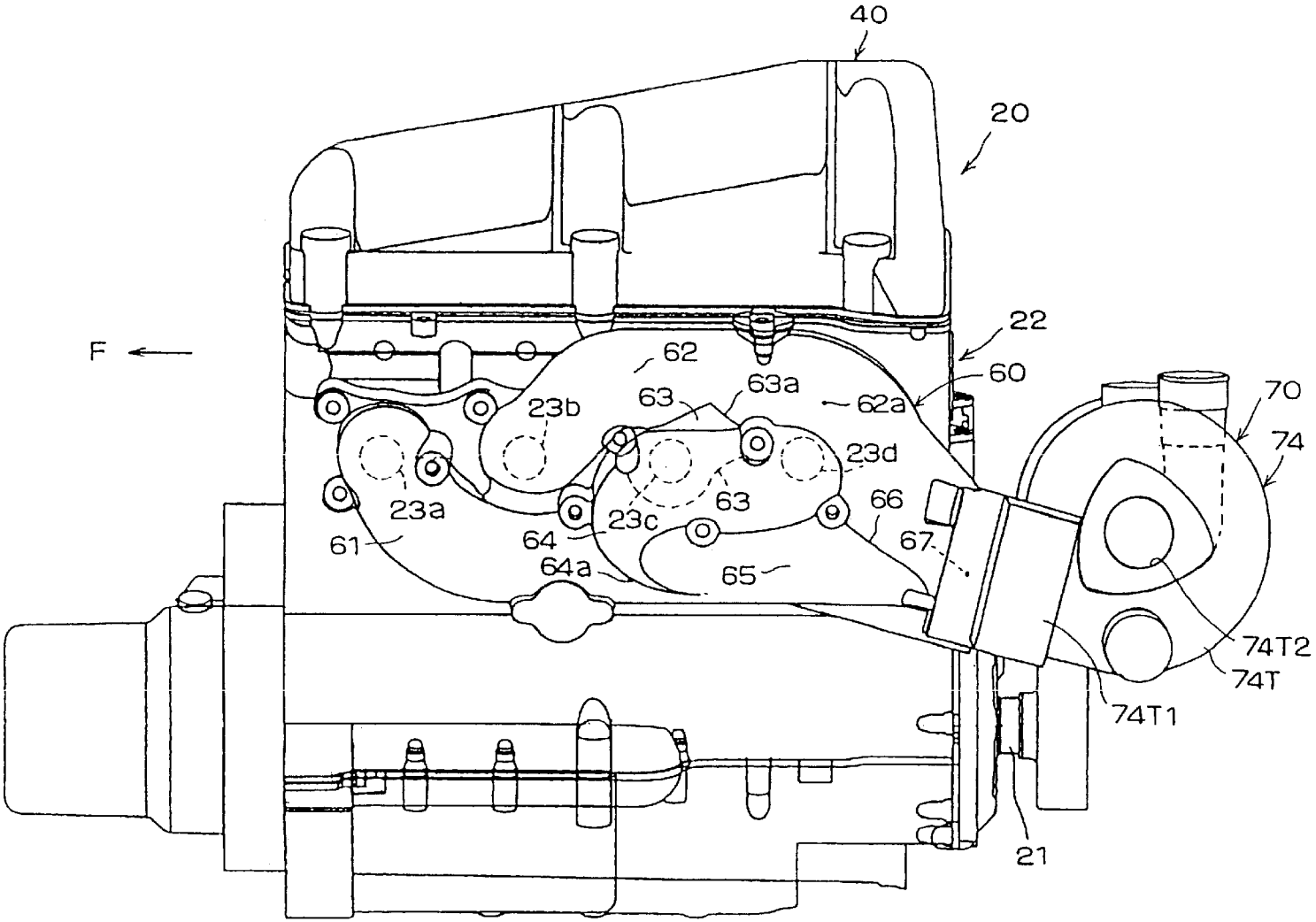
FIG. 4 is a schematic side elevational view of an engine 20.

FIG. 4 is a schematic side elevational view of the engine 20. The engine 20 is a DOHC straight four-cylinder four-cycle engine that is disposed such that a crankshaft (refer to the output power shaft 21) thereof extends in forward and backward directions of the boat body 11.

As shown in FIGS. 1 to 6, an exhaust manifold 60 is provided for the engine 20. The exhaust manifold 60 is provided sidewardly of a cylinder block 22, and has, as apparently shown in FIG. 4, a first exhaust pipe 61 connected to a first exhaust port 23*a* of the cylinder block 22, a second exhaust pipe 62 connected to a second exhaust port 23*b*, a third exhaust pipe 63 connected to a third exhaust port 23*c*, and a fourth exhaust pipe 64 connected to a fourth exhaust port 23*d*.

The second exhaust pipe 62 and the third exhaust pipe 63 extend upwardly and rearwardly from the second exhaust port 23*b* and the third exhaust port 23*c* and are curved such that they join together (the joining portion is denoted by reference character 63*a*) and form a confluence pipe 62*a* which extends rearwardly.

Meanwhile, the first exhaust pipe 61 extends downwardly and rearwardly in a curved state from the first exhaust port 23*a*, and the fourth exhaust pipe 64 is curved forwardly once such that it extends above (this side in a direction perpendicular to the plane of FIG. 4) and across the third exhaust pipe 63, and is further curved downwardly and rearwardly such that it joins to the first exhaust pipe 61 (the joining portion is denoted by reference character 64*a*) to form a confluence pipe 65 which extends rearwardly.

The confluence pipe 65 and the confluence pipe 62*a* described above join together at a joining portion 66, and an exhaust port 67 for the entire exhaust manifold 60 is formed on the downstream side of the joining portion 66.

Rearwardly of the exhaust manifold 60 having such a structure as described above, an exhaust gas turbo charger 70 is provided which is driven to rotate by exhaust gas from the exhaust manifold 60.

The exhaust gas turbo charger 70 includes, as shown in FIG. 3, a turbine 71, a compressor 72, a shaft 73 which connects the turbine 71 and the compressor 72 to each other, and a casing 74.

The exhaust gas turbo charger 70 is disposed such that the shaft 73 thereof is directed in leftward and rightward directions of the boat body 11, and the turbine 71 is disposed adjacent to the exhaust manifold 60 and the compressor 72 is disposed adjacent to an intake port 24 of engine 20.

Figure 5:
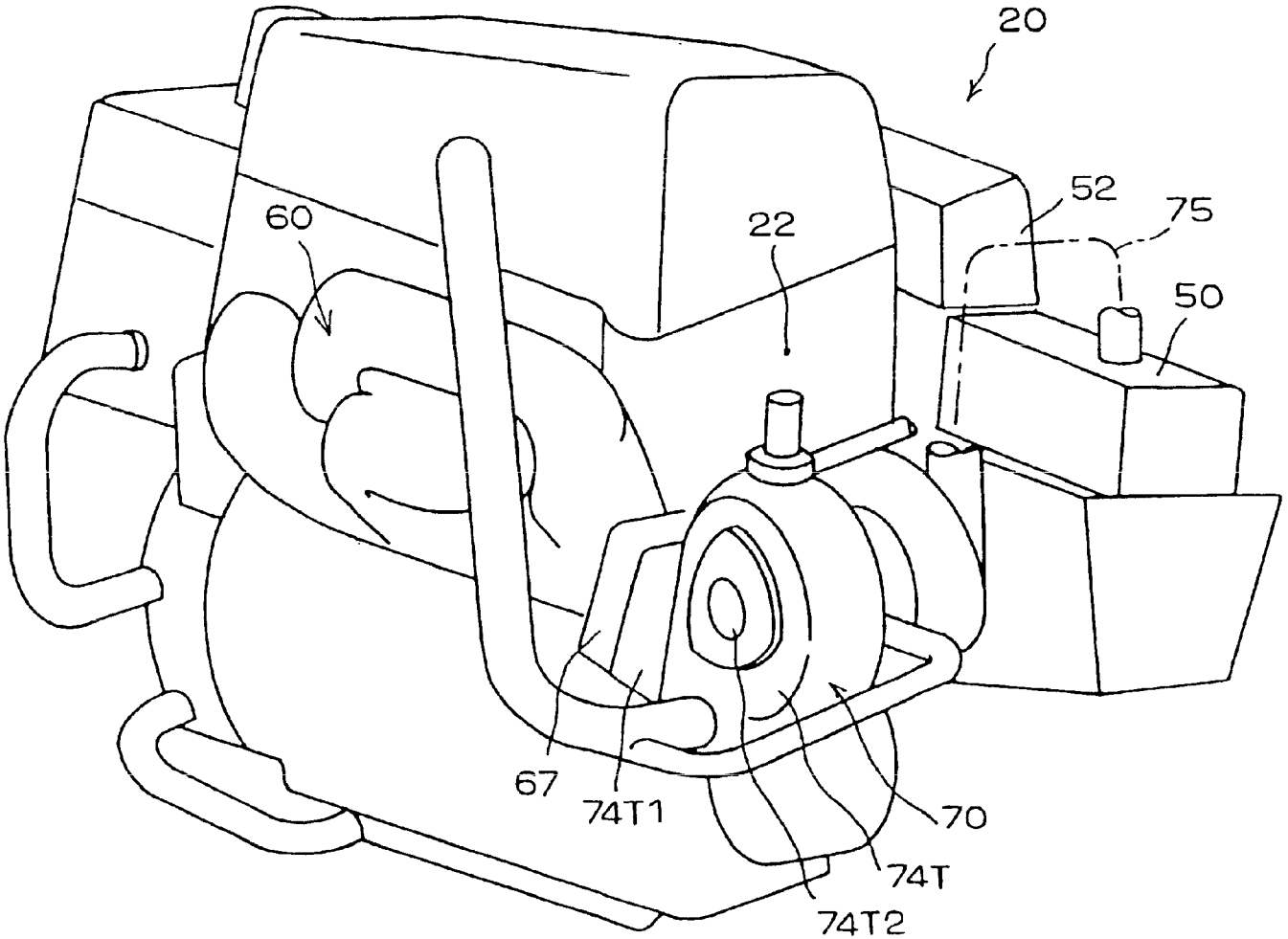
FIG. 5 is a schematic perspective view of the engine as viewed from obliquely rearwardly.

As shown in FIGS. 4 and 5, a turbine portion 74T of the casing 74 has formed therein a connection portion (exhaust gas inlet opening) 74T1 which is connected to the exhaust port 67 of the exhaust manifold 60 and an exhaust port 74T2 through which exhaust gas which has rotated the turbine 71 is exhausted. A first exhaust pipe 80, a muffler 81 and a second exhaust pipe 82 are successively connected to the exhaust port 74T2 as shown in FIGS. 1 and 2, and an exhaust gas exit 83 (refer to FIG. 2) of the second exhaust pipe 82 is opened to the outside of the boat body 11 in the proximity of the jet pump 30 at a rear a rear portion of the boat body 11 (refer to FIG. 3) such that exhaust gas is exhausted finally through the exhaust gas exit 83. In particular, the exhaust gas exit 83 is provided for the exhaust gas turbo charger 70 and is exhausted to the outside of the boat body 11 and is disposed rearwardly of the turbo charger 70.

As is apparent from FIGS. 4 and 5, the exhaust gas turbo charger 70 is provided rearwardly of and very close to the exhaust manifold 60 and is disposed rearwardly of and very close to the engine 20.

Figure 6:
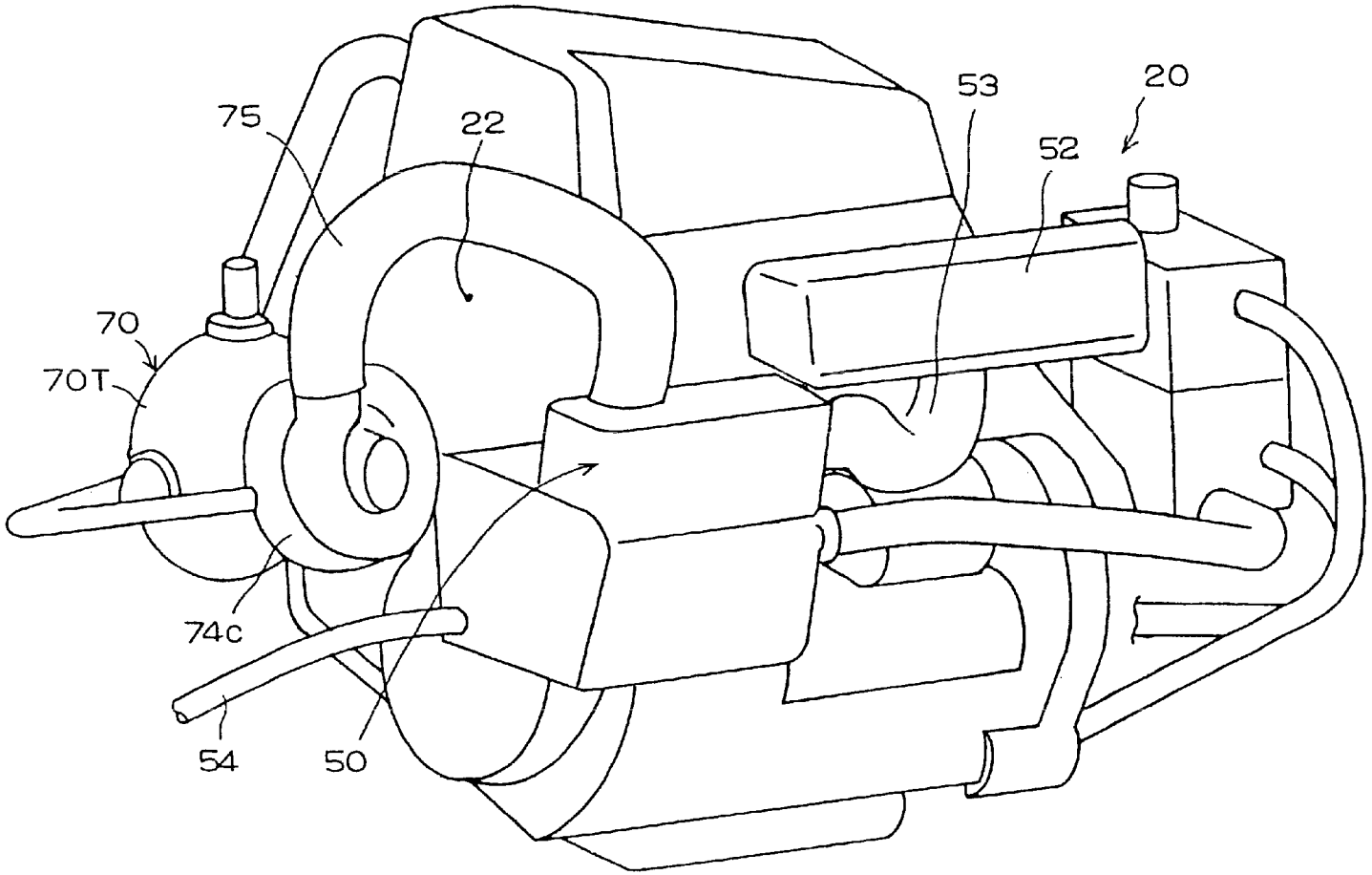
FIG. 6 is a schematic perspective view of the engine as viewed from obliquely rearwardly on the opposite side to that of FIG. 5.

As shown in FIGS. 2, 3 and 6, an inter cooler 50 is connected to the compressor 72 (compressor portion 74C of the casing 74) of the exhaust gas turbo charger 70 through a pipe arrangement 75. The inter cooler 50 is provided sidewardly of the compressor 72.

As shown in FIG. 6, an intake chamber 52 provided sidewardly of the engine 20 is connected to the inter cooler 50 through a pipe arrangement 53 and is connected to the intake port 24 (refer to FIG. 3) of the engine 20. The inter cooler 50 is disposed below the intake chamber 52.

It is to be noted that, in FIG. 6, a cooling water hose 54 is connected to the inter cooler 50. As illustrated in FIG. 3 a head cover 40 includes a breather exit 41. The breather exit 41 is connected to the inter cooler 50 through a breather pipe 42.

With the small-sized ship having such a configuration as described above, the following operation and effects are anticipated. Since the exhaust gas turbo charger 70 which is driven to rotate by exhaust gas from the exhaust manifold 60 of the engine 20 is provided rearwardly of the exhaust manifold 60, a sufficient supercharging effect can be obtained.

Further, since the engine 20 is disposed such that the crankshaft 21 thereof extends in the forward and rearward directions of the boat body 11 and the exhaust gas turbo charger 70 is provided rearwardly of the exhaust manifold 60, the exhaust gas turbo charger 70 can be provided without suffering from very much damage due to the weight balance of the boat 10. In other words, an effect that the weight balance of the boat 10 can be kept while the exhaust gas turbo charger 70 is provided is obtained.

In addition, since the exhaust gas exit 83 for exhaust gas which has come out of the turbo charger 70 and is to be exhausted to the outside of the boat body 11 is disposed rearwardly of the exhaust gas turbo charger 70, laying or disposition of members of an exhaust system such as an exhaust pipe (in the present embodiment, the first exhaust pipe 80, muffler 81 and second exhaust pipe 82) can be performed readily.

Figure 7A:
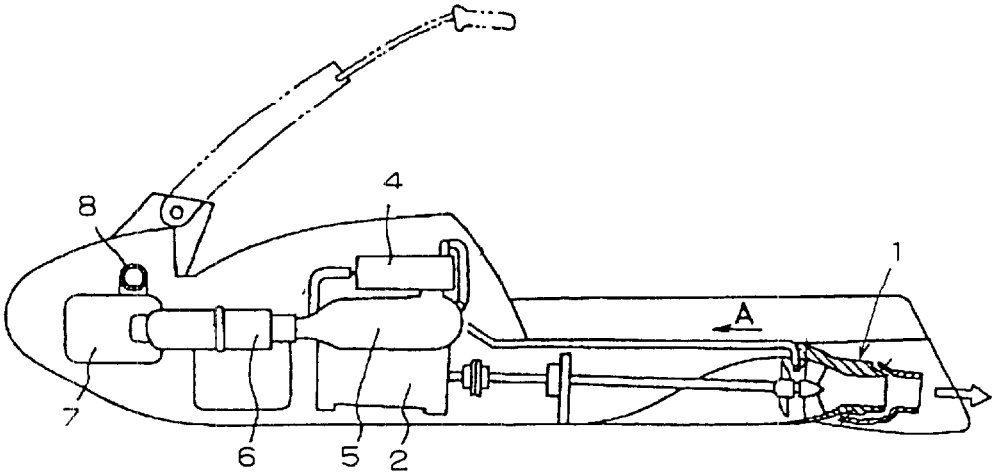
FIGS. 7(*a*) and 7(*b*) are explanatory views of the prior art.
Figure 7B:
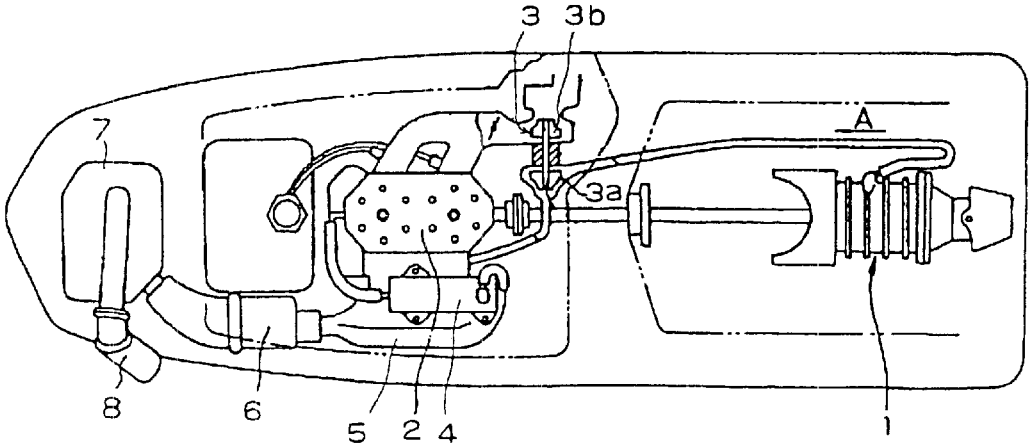

For example, if it is assumed that, in the conventional small-sized boat (FIG. 7) described hereinabove, the exhaust turbo charger is disposed rearwardly of the exhaust manifold 4, then since the exhaust gas exit 8 is provided at a front portion of the boat body, laying of an exhaust pipe from the turbo charger is complicated. Further, if it is assumed that the exhaust gas turbo charger is disposed forwardly of the exhaust manifold 4, then although it is considered that laying of an exhaust pipe from the turbo charger is facilitated, there is the possibility that the weight balance of the boat in this instance is damaged significantly.

In contrast, with the small-sized boat 10 of the present embodiment, since the exhaust gas exit 83 for exhaust gas which has come out of the turbo charger 70 and is to be exhausted to the outside of the boat body 11 is disposed rearwardly of the turbo charger 70, laying or disposition of members of an exhaust system such as an exhaust pipe can be performed readily, and the weight balance of the boat 10 is not damaged significantly Since the exhaust gas turbo charger 70 is provided rearwardly of and very close to the exhaust manifold 60, the exhaust gas turbo charger 70 is driven efficiently, and as a result, a more sufficient supercharging effect can be obtained.

Besides, since the exhaust gas turbo charger 70 is provided rearwardly of and very close to the exhaust manifold 60, the weight balance is maintained (concentration of the weight is achieved), and the steering performance of the boat body is not damaged although the turbo charger 70 is provided.

Since the exhaust gas turbo charger 70 is provided rearwardly of and very close to the engine 20, the weight balance is maintained (concentration of the weight is achieved), and the steering performance of the boat body 11 is not damaged although the turbo charger 70 is provided.

Since the exhaust gas turbo charger 70 is disposed such that the shaft 73 which connects the turbine 71 and the compressor 72 thereof to each other is directed in the leftward and rightward directions of the boat body 11, the exhaust gas turbo charger 70 can be disposed more closely to the engine 20. Accordingly, it is possible to keep the weight balance better (to achieve a concentration of the weight), and as a result, the steering performance of the boat body can be kept well although the turbo charger 70 is provided.

Besides, since the turbine 71 of the turbo charger 70 is disposed adjacent to the exhaust manifold 60 and the compressor 72 is disposed adjacent to the intake port 24 of the engine 20, connection between the exhaust gas turbo charger 70 and the engine 20 can be performed readily.

Particularly, connection between the exhaust manifold 60 and the exhaust gas turbo charger 70 and connection between the exhaust gas turbo charger 70 and the inter cooler 50 and intake chamber 52 are facilitated.

Since the inter cooler 50 is connected to the compressor of the exhaust gas turbo charger 70, the supercharging efficiency of the exhaust gas turbo charger 70 is augmented. Besides, since the inter cooler 50 is provided sidewardly of the compressor 72, the weight balance can be maintained (concentration of the weight is achieved), and as a result, the steering performance of the boat body 11 can be maintained although the turbo charger 70 and the inter cooler 50 are provided.

Since the inter cooler 50 is disposed below the intake chamber 52 which follows the inter cooler 50 and is provided sidewardly of the engine, even if water should enter the turbo charger 70, the water is less likely to be admitted into the body of the engine 20. Accordingly, the engine body is less likely to be damaged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A small-sized boat comprising:

an engine having an exhaust manifold;

a crankshaft extending in forward and backward directions of a boat body;

an exhaust gas turbo charger which is driven to rotate by exhaust gas from said exhaust manifold, said exhaust gas turbo charger being provided rearwardly of said exhaust manifold; and an inter cooler which is connected to a compressor of said exhaust gas turbo charger and disposed below an intake chamber which follows said inter cooler, said inter cooler being provided sidewardly of said engine and said compressor.

2. The small-sized boat according to claim 1, wherein an exhaust gas exit for the exhaust gas from said exhaust gas turbo charger is disposed rearwardly of said turbo charger for exhausting to the outside of said boat body.

3. The small-sized boat according to claim 1, wherein said exhaust gas turbo charger is provided rearwardly of and adjacent to said exhaust manifold.

4. The small-sized boat according to claim 2, wherein said exhaust gas turbo charger is provided rearwardly of and adjacent to said exhaust manifold.

5. The small-sized boat according to claim 1, wherein said exhaust gas turbo charger is disposed rearwardly of and adjacent to said engine.

6. The small-sized boat according to claim 2, wherein said exhaust gas turbo charger is disposed rearwardly of and adjacent to said engine.

7. The small-sized boat according to claim 3, wherein said exhaust gas turbo charger is disposed rearwardly of and adjacent to said engine.

8. The small-sized boat according to claim 5, wherein said exhaust gas turbo charger is operatively arranged relative to a shaft which connects a turbine and a compressor thereof to each other, said shaft is directed in leftward and rightward directions of said boat body, and said turbine is disposed adjacent to said exhaust manifold and said compressor is disposed adjacent to an intake port of said engine.

9. The small-sized boat according to claim 8, wherein an inter cooler is connected to said compressor of said exhaust gas turbo charger and is provided sidewardly of said compressor.

10. The small-sized boat according to claim 2, wherein an inter cooler is connected to a compressor of said exhaust gas turbo charger and disposed below an intake chamber which follows said inter cooler and is provided sidewardly of said engine.

11. The small-sized boat according to claim 3, wherein an inter cooler is connected to a compressor of said exhaust gas turbo charger and disposed below an intake chamber which follows said inter cooler and is provided sidewardly of said engine.

12. The small-sized boat according to claim 5, wherein an inter cooler is connected to a compressor of said exhaust gas turbo charger and disposed below an intake chamber which follows said inter cooler and is provided sidewardly of said engine.

13. The small-sized boat according to claim 8, wherein an inter cooler is connected to a compressor of said exhaust gas turbo charger and disposed below an intake chamber which follows said inter cooler and is provided sidewardly of said engine.

14. The small-sized boat according to claim 9, wherein an inter cooler is connected to a compressor of said exhaust gas turbo charger and disposed below an intake chamber which follows said inter cooler and is provided sidewardly of said engine.

* * * * *